US012173951B2

(12) United States Patent
Malausa et al.

(10) Patent No.: US 12,173,951 B2
(45) Date of Patent: Dec. 24, 2024

(54) HOUSEHOLD APPLIANCE WITH A CRISPER

(71) Applicant: ELECTROLUX APPLIANCES AKTIEBOLAG, Stockholm (SE)

(72) Inventors: Andrea Malausa, Santa-Lucia-di-Piave (IT); Matteo Simioni, Volpago del Montello (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 237 days.

(21) Appl. No.: 17/770,453

(22) PCT Filed: Oct. 28, 2019

(86) PCT No.: PCT/EP2019/079427
§ 371 (c)(1),
(2) Date: Apr. 20, 2022

(87) PCT Pub. No.: WO2021/083489
PCT Pub. Date: May 6, 2021

(65) Prior Publication Data

US 2022/0381502 A1 Dec. 1, 2022

(51) Int. Cl.
*F28D 17/04* (2006.01)
*F25D 17/04* (2006.01)
*F25D 25/02* (2006.01)

(52) U.S. Cl.
CPC ..... *F25D 17/042* (2013.01); *F25D 25/025* (2013.01)

(58) Field of Classification Search
CPC ..... F25D 17/042; F25D 25/025
USPC ..... 62/407
See application file for complete search history.

(56) References Cited

U.S. PATENT DOCUMENTS

2004/0031705 A1 2/2004 Detemple
2013/0340465 A1 12/2013 Park et al.

FOREIGN PATENT DOCUMENTS

| | | | |
|---|---|---|---|
| CN | 101766321 | * | 7/2010 |
| CN | 101766321 A | * | 7/2010 |
| CN | 106546054 | | 3/2017 |
| CN | 206291610 U | * | 6/2017 |
| CN | 207132627 | | 3/2018 |
| EP | 3136027 | | 3/2017 |
| JP | S6363418 | | 3/1988 |

(Continued)

OTHER PUBLICATIONS

International Search Report for PCT/EP2019/079427 dated Aug. 5, 2020, 5 pages.

*Primary Examiner* — Davis D Hwu
(74) *Attorney, Agent, or Firm* — Pearne & Gordon LLP

(57) ABSTRACT

Household appliance (2), comprising a casing (4) defining an inner compartment (10) in which a crisper (30) is arranged, whereby said crisper (30) comprises a frontal part (32) and further comprises a permeable membrane (70) allowing contact from an inner space of said crisper (30) to an atmosphere outside of said crisper (30), whereby said membrane (70) is arranged on said frontal part (32), whereby a handle (58) is provided at said frontal part (32), whereby said handle (58) and said membrane (70) are dimensioned and arranged in such a way that said membrane (70) is at least partially covered from view by said handle (58) in a frontal direction (72) towards said crisper (30).

14 Claims, 8 Drawing Sheets

(56) References Cited

FOREIGN PATENT DOCUMENTS

| | | |
|---|---|---|
| JP | 2001174136 | 6/2001 |
| JP | 2018109510 | 7/2018 |

* cited by examiner

HOUSEHOLD APPLIANCE WITH A CRISPER

FIELD OF THE INVENTION

The present invention concerns the field of household appliances, especially refrigerating and/or freezing appliances. In particular, the present invention refers to household appliance with a crisper.

BACKGROUND ART

Appliances for the purpose of cooling or freezing food can be built as separate devices or as combined devices, whereby in a refrigerating compartment, goods such as vegetables, milk products etc. are cooled and in a freezing compartment, goods such as ice cream or frozen food can be stowed.

These appliances in the refrigerating compartment typically comprise a crisper for stowing vegetables. The crisper is typically arranged in a bottom region of the refrigerating compartment and can be built as a drawer. Moreover, the crisper can be provided in the freezing compartment, sometime several crispers are stacked one over the other along the vertical direction. The crisper be can equipped with a membrane with the purpose to control the humidity in the crisper, especially to prevent entry of humidity, thereby slowing down the degradation of the food inside the crisper.

It is known to place the membrane in several places, allowing the communication between the internal space of the crisper and the external ambient; for example, it is known to arrange the membrane on the frontal part of the crisper. The disadvantage of such a configuration is that membrane is exposed on the front and can be damaged by operation the crisper or by handling of items. Additionally, the membrane disturbs the aesthetical impression of the crisper.

Alternatively, it is known to arrange the membrane on a top part of the crisper. The disadvantage of such a configuration is that damages can occur by items which are dropped by a user during handling.

SUMMARY OF THE INVENTION

The aim of the invention is to provide a household appliance in which the membrane is protected from damage.

It is a further aim to provide a household appliance with a crisper with an improved visual appearance.

The invention therefore relates to a household appliance, comprising a casing defining an inner compartment in which a crisper is arranged, whereby the crisper comprises a frontal part and further comprises a permeable membrane allowing contact from an inner space of the crisper to an atmosphere outside of the crisper, whereby the membrane is arranged on the frontal part, and whereby a handle is provided at the frontal part, whereby the handle and the membrane are dimensioned and arranged in such a way that the membrane is at least partially covered from view by the handle in a frontal direction towards the crisper.

Preferred embodiments of the invention are described in relation to the dependent claims and the description of the enclosed drawings.

The invention is based on the consideration that the membrane fulfills a significant function and is essential for the quality and reliability of the appliance since it is responsible for the life period of the food stored in the crisper. If the membrane is arranged on a top part of the crisper, damage can likely occur by items which are dropped by a user during handling, thereby destroying or weakening the important functionality of the membrane. If the membrane is arranged in the front, it also can get damaged, and it reduces the appeal of the crisper. Especially for high-quality appliances, the user expects a high-quality outer finish but also an aesthetically appealing interior of the appliance.

Applicant has found that an aesthetically advantageous design can be designed with simultaneously a reliable protection of the membrane by arranging the membrane on the frontal part of the crisper behind a handle in such a way that is hidden from the view of the user during regular handling of the crisper. The frontal direction towards the crisper preferably denotes a viewing direction perpendicular to a front face of the handle and/or frontal part of the crisper and pointing towards the handle and/or frontal part. Preferably, in this direction there is a strong of full overlap of handle with membrane, i.e. the membrane in this projection is to a large extent or fully hidden behind the handle.

According to the invention, the handle provided at the frontal part is suitable to allow the pulling or pushing of the crisper from or to its closure position through the action of the user to said handle.

The membrane is preferably arranged and dimensioned to remain, in its working position, at least partially behind the handle. This applies preferably to any working position (inserted to extracted) of the cover of the crisper.

Preferably the height of the handle, preferably essentially, corresponds to the height of the membrane.

Advantageously, in a lateral direction said membrane extends over more than half of the width of the crisper, especially more than two thirds. In this way, the humidity control extends over a wide region of the crisper, which supports to prevent the gathering of humidity in the crisper.

The handle is preferably detachable connected to said frontal part, especially by a snap connection. In this way, in order to match a design of the household appliance, only the handle needs to be replaced, while the frontal part, drawer part and housing of the crisper can stay the same. Therefore, less different components need to be manufactured for appliances with different designs.

Advantageously, the frontal part is detachable connected to the drawer part. In this way, for replacing the membrane, the frontal part can be detached, allowing a convenient access to the membrane.

Preferably, the connection between the frontal part and the drawer part is a snap connection, preferably with three snap elements arranged on the drawer part which engage in corresponding recesses on the frontal part or vice versa.

In a preferred embodiment the membrane is arranged in at least one shell which is attached, preferably detachable attached, to the frontal part. In this way, access to the membrane for replacement is convenient by detaching the shell or part of it.

The shell is preferably attached to the frontal part on the side facing an interior space of the crisper in a mounted position.

Advantageously, the shell comprises a first shell and a second shell attached to each other, and the membrane is arranged between said first shell and said second shell. The membrane in this way is preferably sandwiched between the shells and can be easily replaced by detaching both shells from each other.

The shells are preferably attached to each other by a snap connection which allows an easy and convenient connection and detachment of both shells with each other.

In a preferred embodiment, a first shell which in the mounted state is closer to the frontal part comprises a fulcrum which engages with a corresponding recess provided on the second shell. The first shell preferably comprises tooth seats in which snap teeth of the other shell engage.

In a preferred embodiment, on the frontal part two or more membranes are arranged adjacent to each other. This allows to use smaller membranes or to use membranes with different properties. Preferably, all of these membranes are partially covered from view by said handle.

Preferably, at least two of these membranes differ in their permeability. This allows a precise control of humidity in the crisper. In case of different compartments in the crisper, especially in the case that at least two compartments are adjacent to the front part, different foods can be provided for each compartment and membranes with different characteristics (material, permeability, etc.) can be used which are respectively optimized for the corresponding food.

Preferably, a decorative element is arranged on the handle. By providing a decorative element, the interior appearance of the appliance can be brought in line with the overall design of the appliance. As customers value also the interior design of the appliance, in this way a high-quality impression of the appliance can be transported to the customer.

In a preferred embodiment, the household appliance is built as refrigerating and/or freezing appliance.

The invention also relates to a method for mounting a membrane to a crisper comprising a frontal part, the membrane allowing contact from an inner space of the crisper to an atmosphere outside of the crisper, whereby the membrane is positioned in at least one shell, and whereby the shell is associated, preferably detachable associated, to the frontal part.

Preferably the said membrane is arranged in such a way that it is at least partially covered from view by the handle in a frontal direction towards the crisper.

In the embodiment described above with the shells comprising corresponding fulcrum and recess as wells as snap teeth a tooth seats, the snap connection between the shells preferably is provided firstly through the engagement of the fulcrum with the recess, then rotating the first shell around the fulcrum toward the second shell up to engagement of the snap teeth with the tooth seats.

The advantages of the invention are especially as follows. By arranging the membrane of the crisper on the frontal side behind a handle, the membrane is less exposed to damage and therefore the lifetime of the appliance is increased. Since the membrane is not visible, the design of the front side of the crisper can be chosen depending on other design requirements. An arrangement of the membrane in at least one shell allows an easy exchange of the membrane.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

Identical parts are labelled with the same reference numerals.

DETAILED DESCRIPTION

Figure 1:
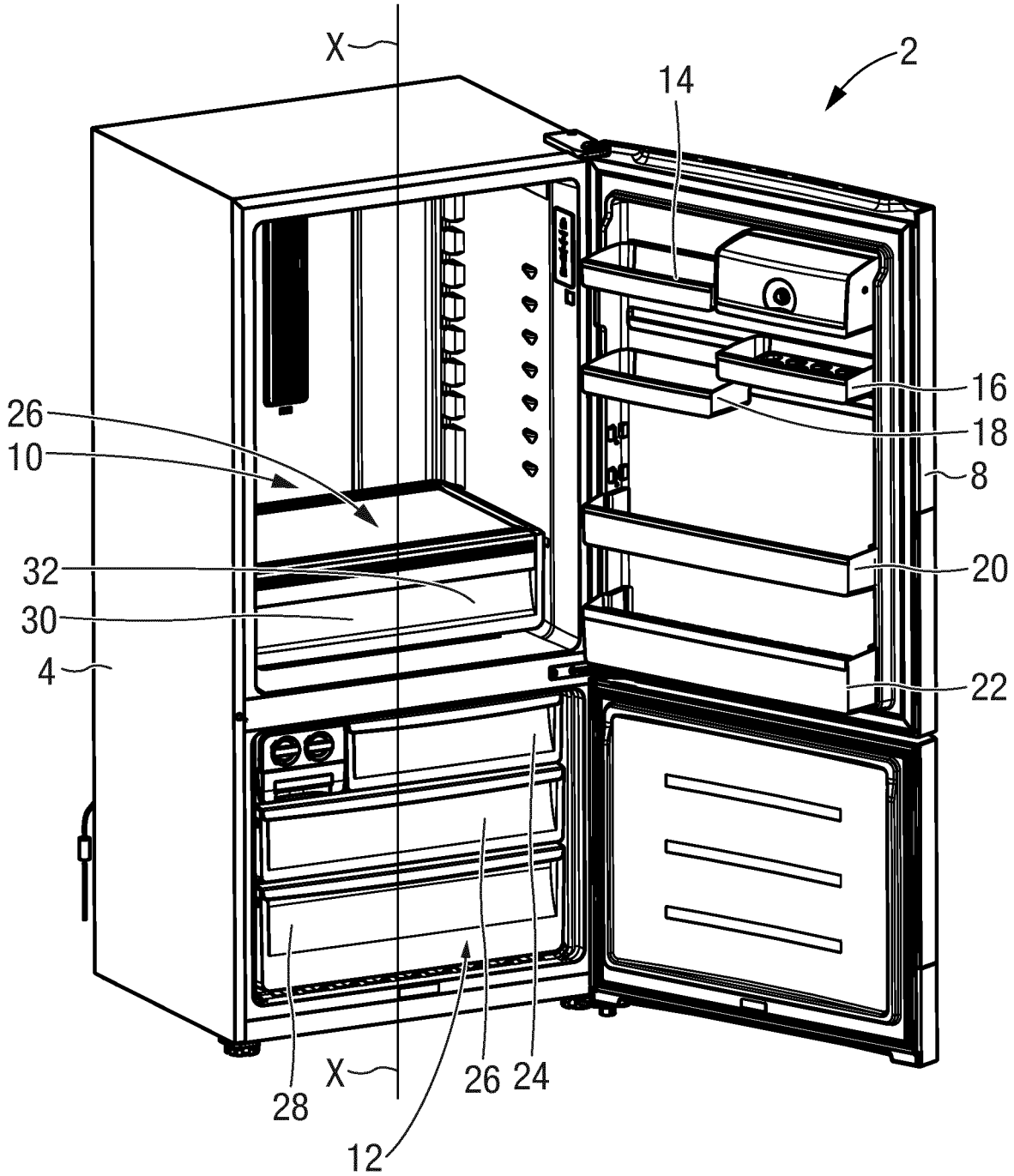
FIG. 1 shows a household appliance with a crisper in a closed configuration in a preferred embodiment in a perspective view.

In FIG. 1, a household appliance 2 is shown which is preferably built as a combined refrigerating/freezing appliance with a casing 4 in which a first inner compartment 10 is defined which is a refrigerating compartment. In casing 4, a second inner compartment 12 is defined which is a refrigerating compartment. In a door 8 for compartment 10, several shelves 14, 16, 18, 20, 22 are preferably arranged in which food can be stowed. In compartment 12 which is the freezing compartment, several drawers 24, 26, 28 are arranged in which food can be stowed.

According to alternative embodiments, the household appliance can comprise a casing defining a refrigerating compartment only, or more than one refrigerating compartment.

Moreover, according to a further alternative embodiment, one door only can be provided, allowing the aperture and the closure of the whole internal space defined by the casing 4.

Figure 2:
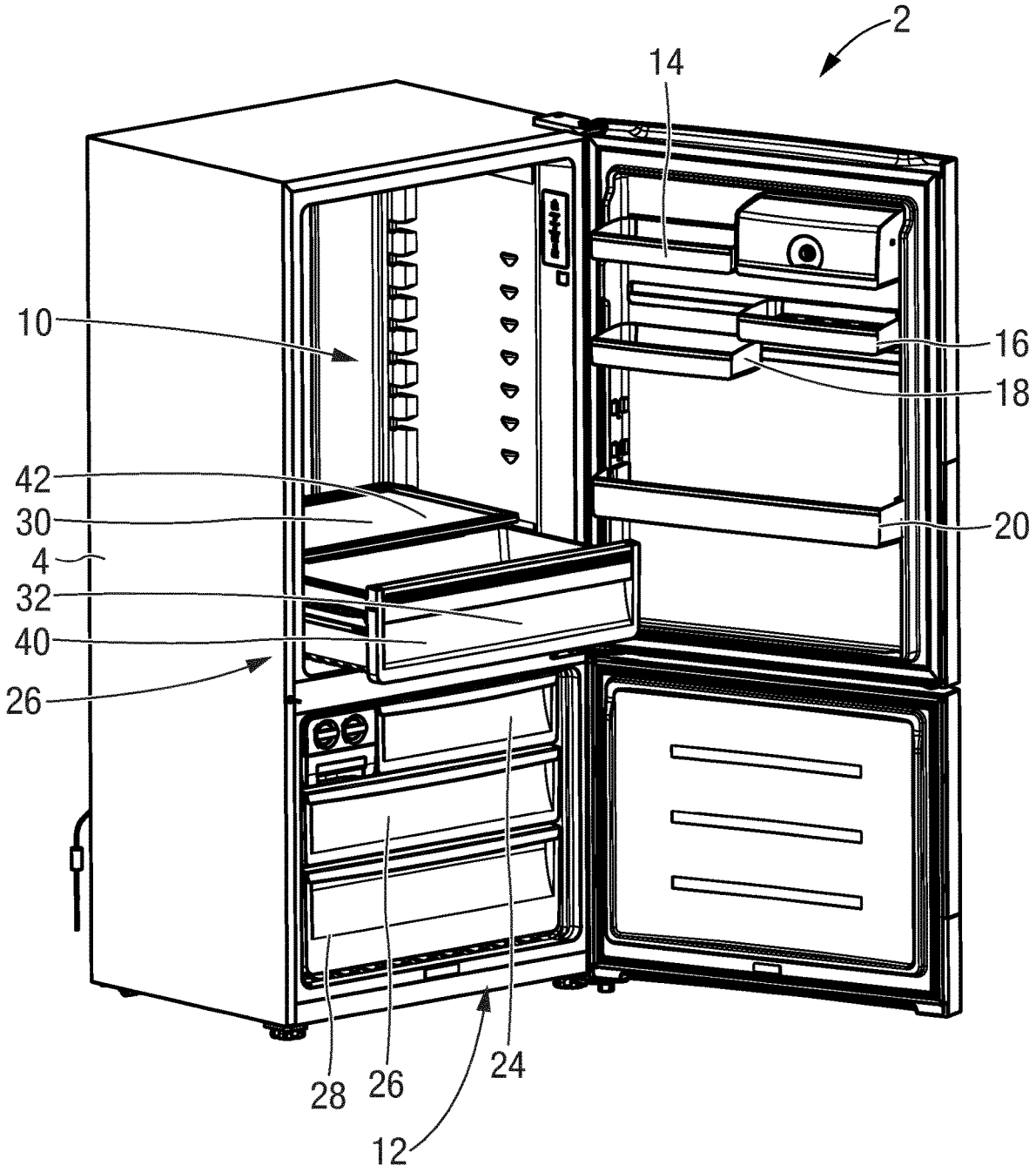
FIG. 2 shows the household appliance with a crisper in an opened configuration according to FIG. 1 in a perspective view.
Figure 3:
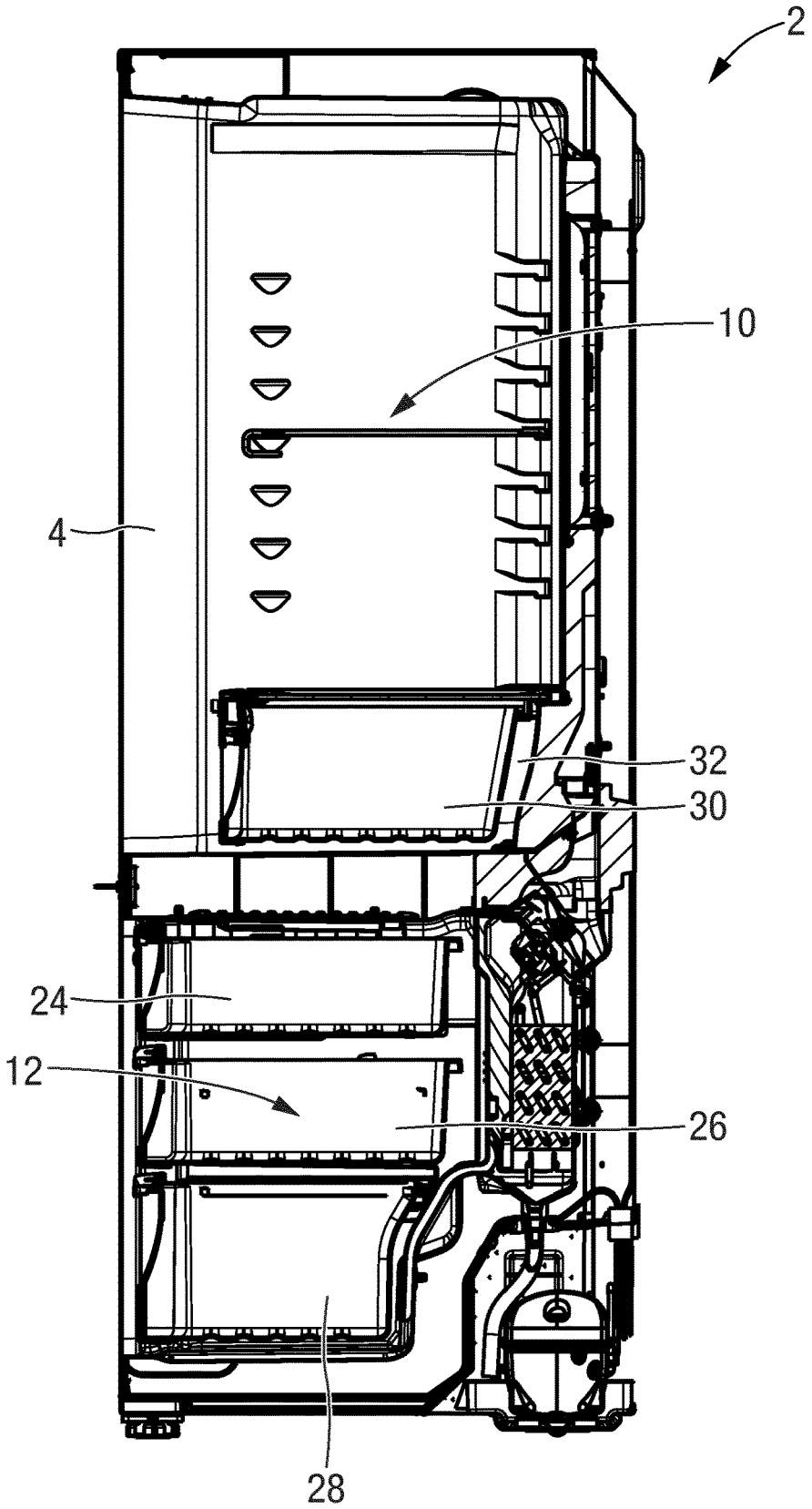
FIG. 3 shows a cross section of the household appliance shown in FIG. 1 along the axis X-X with a crisper in an closed configuration according to FIG. 1 in a side view.

In compartment 10 in a bottom region 26, a crisper 30 is arranged which comprises a frontal part 32 and which will be described below in detail. In the configuration shown, the crisper 30 is in a closed state. In FIG. 2, the household appliance 2 of FIG. 1 is shown in a further perspective view in which the crisper 30 is shown in a partially opened state. As can be seen in this FIG., the frontal part 32 is a front part of a drawer part 40 which can be extracted from a crisper housing 42. In FIG. 3, the household appliance 2 is shown in a side view.

Figure 4:
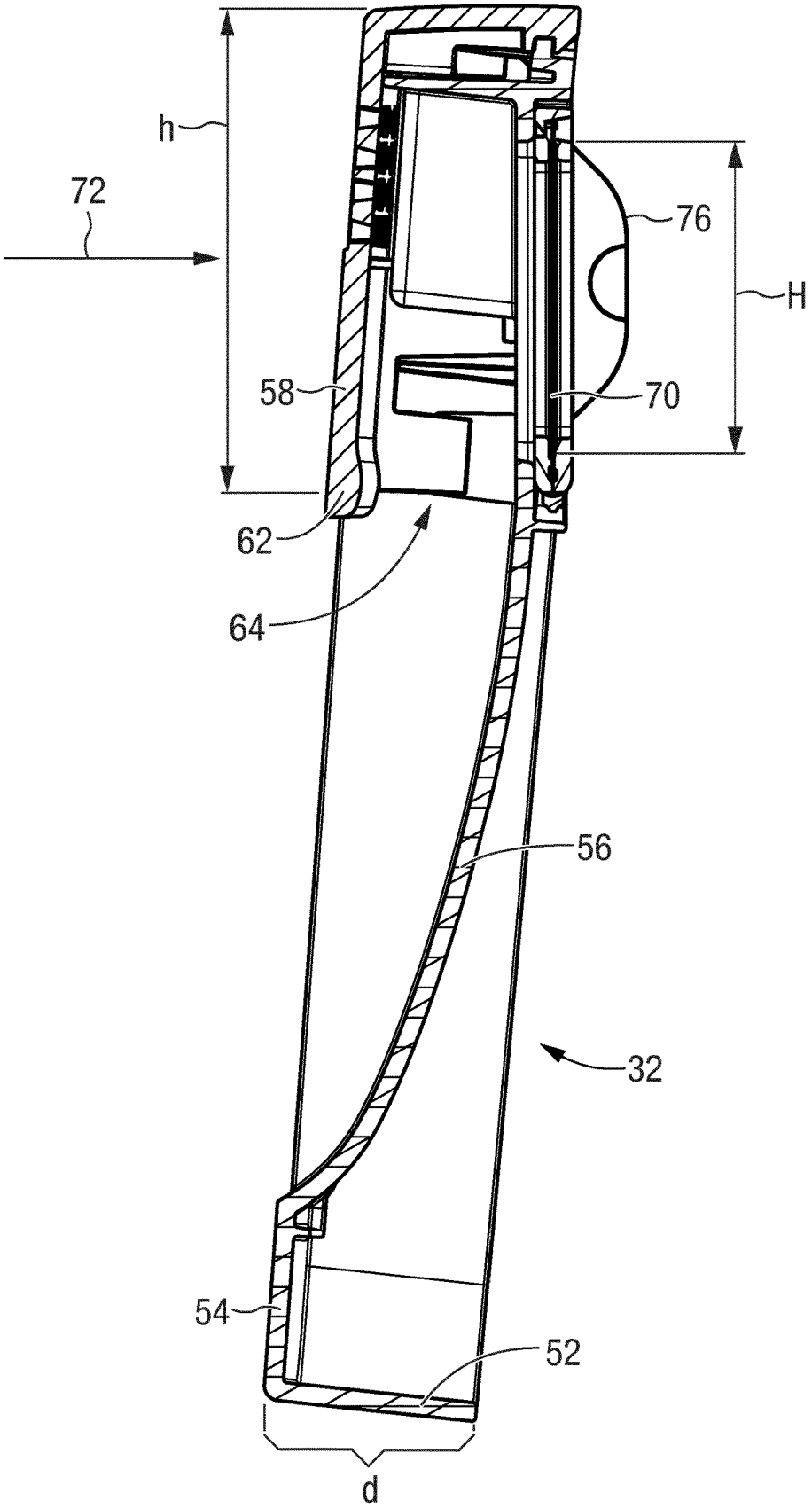
FIG. 4 shows a side view of a frontal part of the crisper.

In FIG. 4, a preferred embodiment of the frontal part 32 of crisper 30 is shown. The frontal part 32 preferably comprises a bottom part 52 which in a mounted position is oriented horizontally and an adjacent bottom edge part 54 which is oriented perpendicular to bottom part 52 and in the mounted position is oriented vertically. Bottom part 52 preferably defines a depth d of frontal part 32. A part 56 bends from part 54 upwards and extends essentially over the depth d. Connected to part 56 and therefore to frontal part 32 is a handle 58 preferably with a lip 62. In the shown embodiment, since part 56 bends away from part 54, a space 64 is provided between part 56 and lip 62 into which the user can put her/his fingers in order to pull out the drawer 40.

Attached to frontal part 32 is a membrane 70 which due its permeability allows an exchange of atmosphere of the crisper 30 and the surrounding and avoids a building up of humidity within the crisper 30.

The height h of handle 58 is in the present preferred embodiment larger than the height H of membrane 70. In this way, when looking in a frontal direction 72 towards frontal part 32, the membrane 70 is hidden from the view of the user. Behind membrane 70, a protruding element 76 is preferably arranged which serves to detach membrane 70 from frontal part 32 when the membrane should be exchanged.

Figure 5:
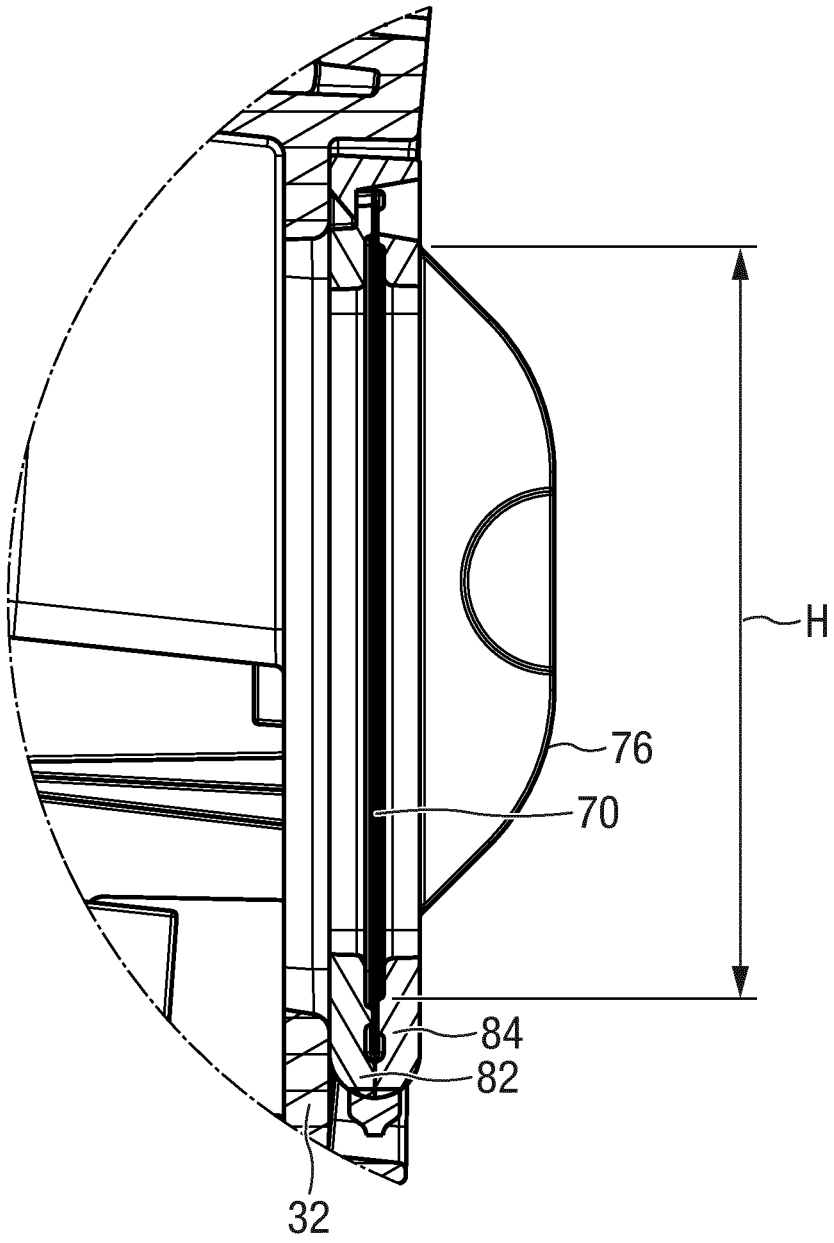
FIG. 5 shows an enlarged detailed view of FIG. 4.

In FIG. 5, an enlarged view of part of frontal part 32 and membrane 70 is shown. As will be further discussed in connection with FIG. 6, membrane 70 is preferably arranged between a first shell 82 and a second shell 84. In the mounted configuration, membrane 70 is sandwiched between these two shells 82, 84.

Figure 6:
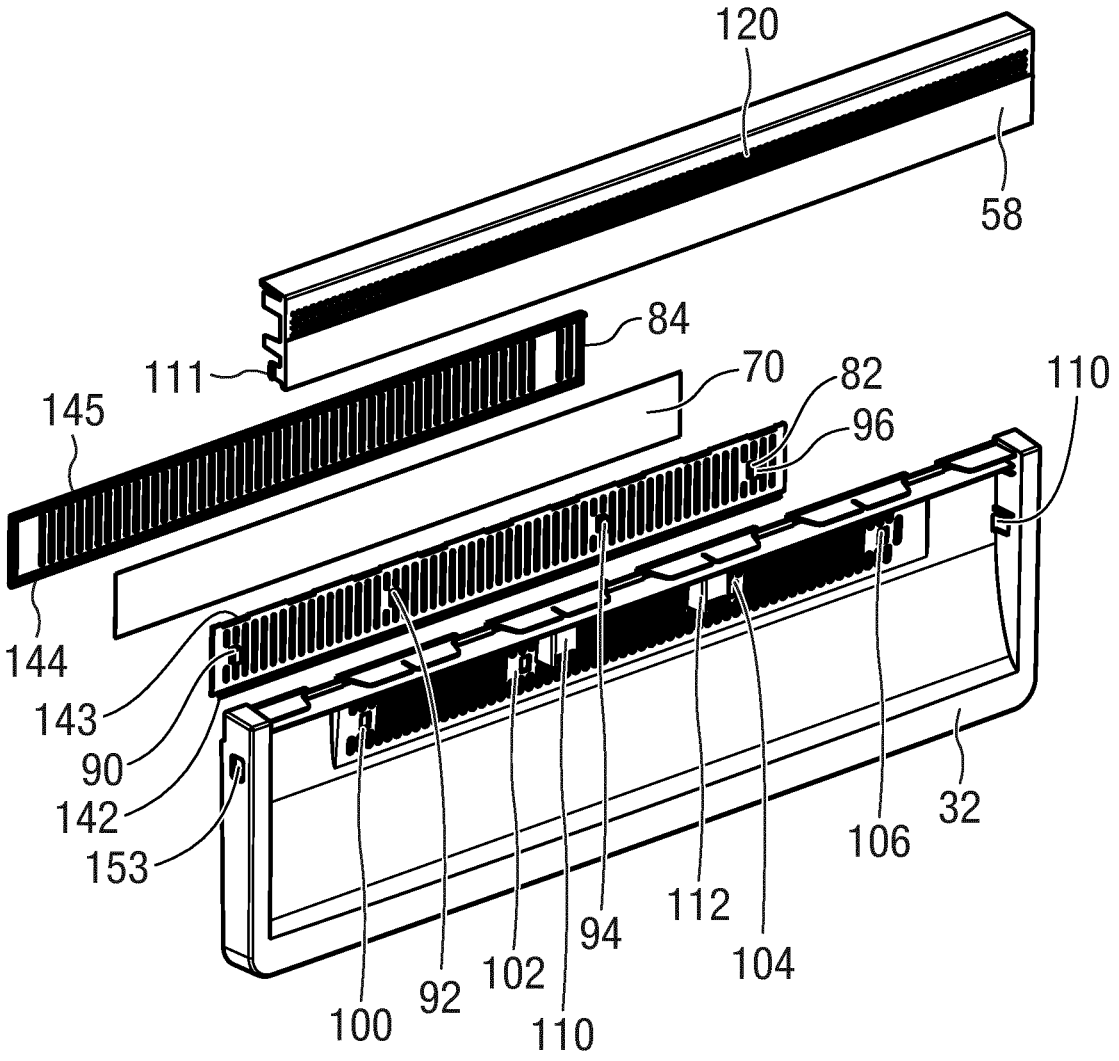
FIG. 6 shows the frontal part in an explosive view.
Figure 7:
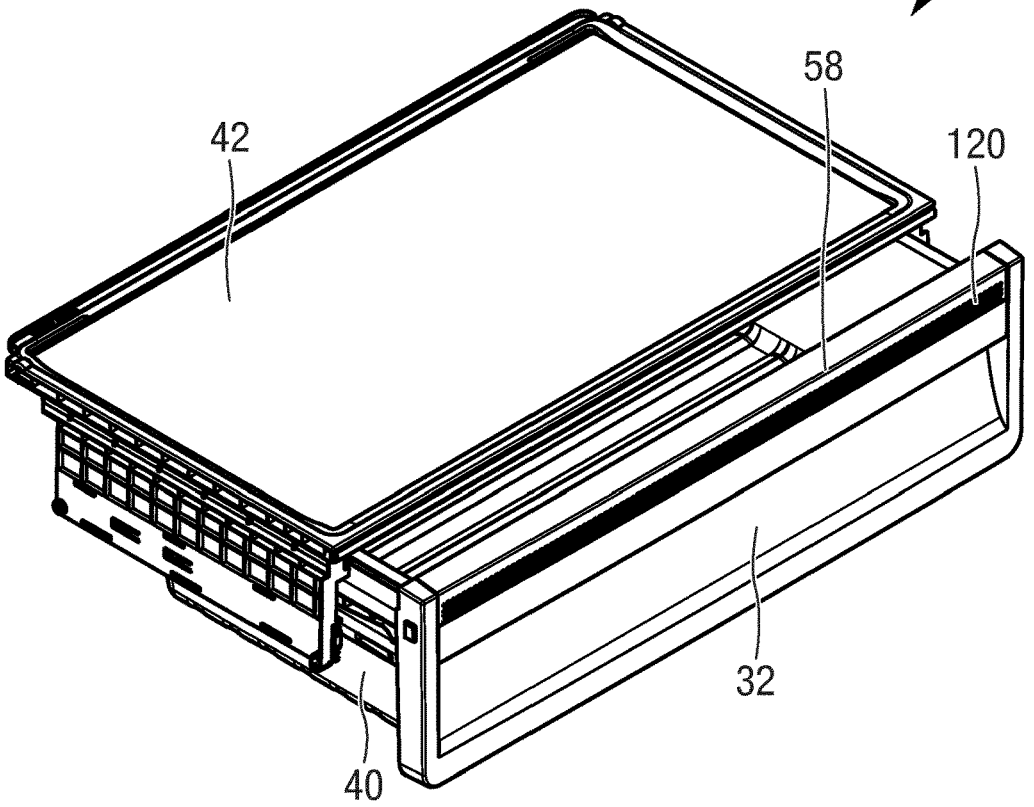
FIG. 7 shows the crisper in a perspective view in a partially opened state.
Figure 8:
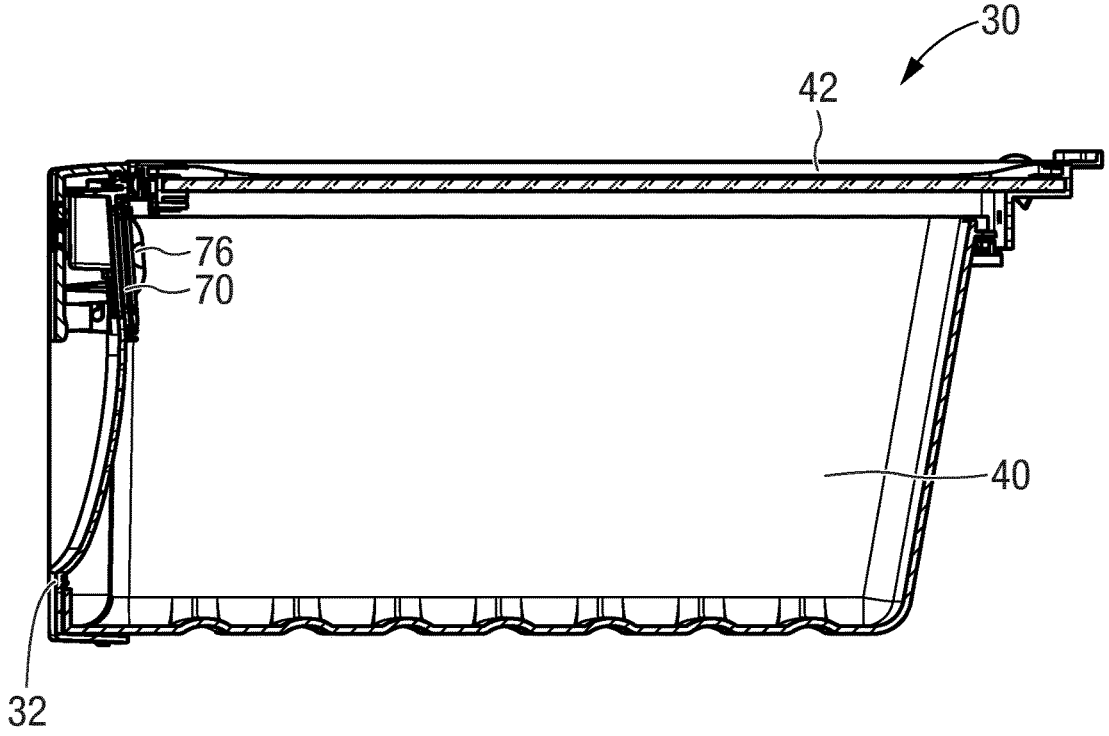
FIG. 8 shows a cross-section of the crisper along the line A-A shown in FIG. 10.
Figure 9:
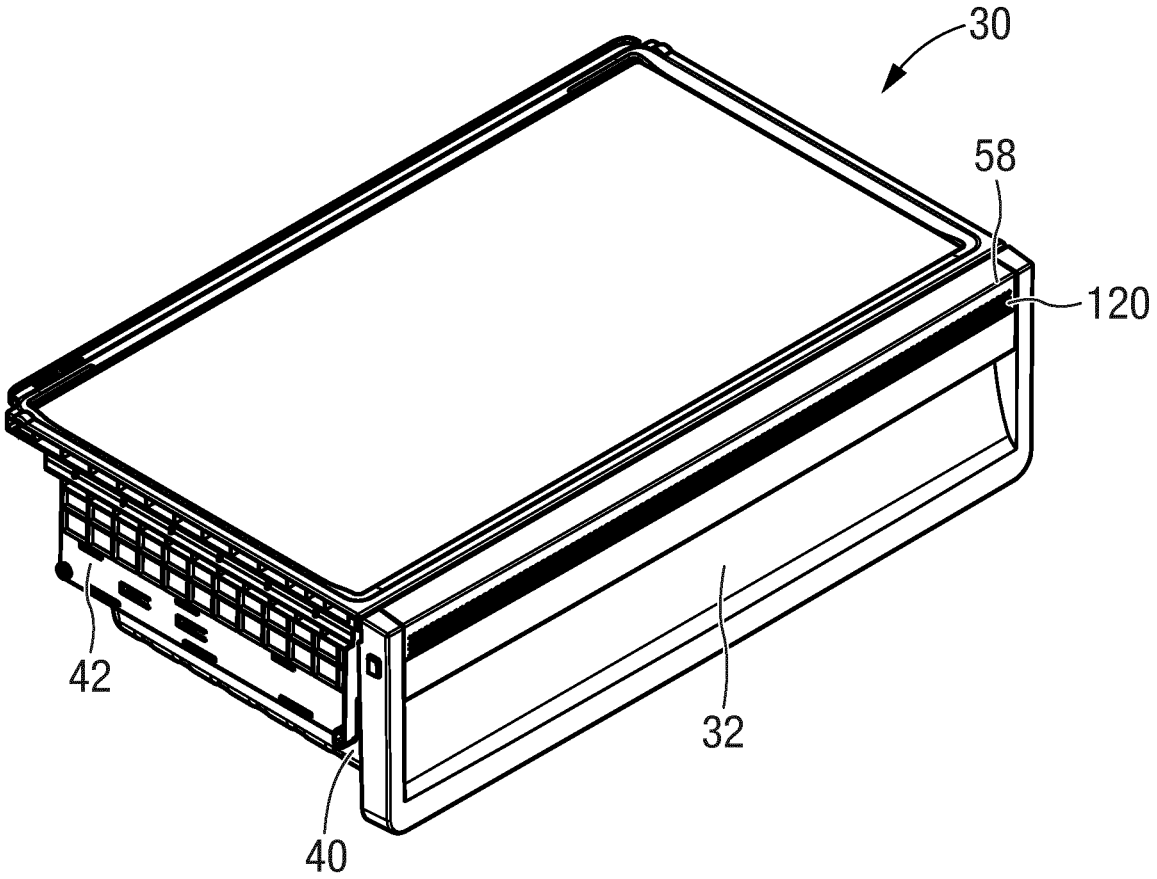
FIG. 9 shows the crisper in a perspective view with the crisper in a closed state.
Figure 10:
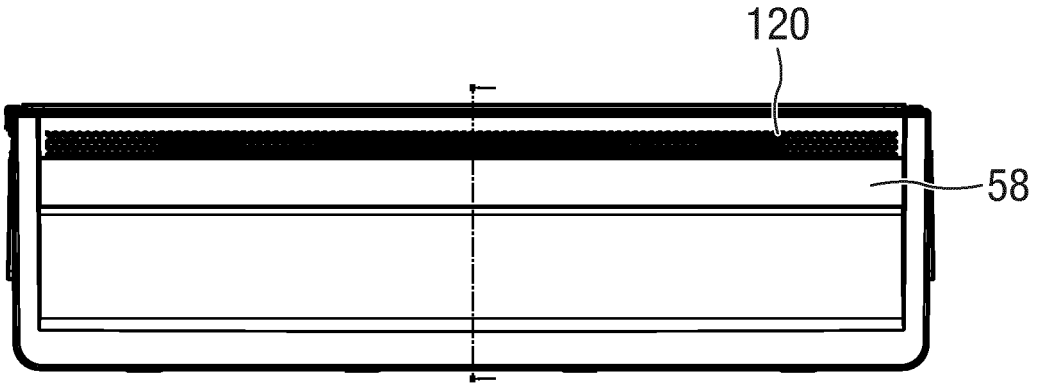
FIG. 10 shows the frontal part of the crisper in a front view.

In FIG. 6, frontal part 32, handle 58, shells 82, 84 and membrane 70 are shown in an explosive view. In the mounted configuration, membrane 70 is preferably arranged in a sandwiched style between two shells 82, 84, In this mounted configuration, first shell 82 is facing frontal part 32/handle 58 and second shell 84 is facing the drawer part of crisper 30. Shell 82 preferably comprises snap elements, preferably four snap elements 90, 92, 94, 96 which engage with corresponding recesses 100, 102, 104, 106 in frontal part 32. Shell 84 is preferably connected to shell 82 by a snap connection with respective snap elements.

Also, the handle 58 is preferably connected to frontal part 32 by a snap connection. Handle 58 preferably comprises recesses/snap elements 111 which engage with corresponding snap elements/recesses 110, 112 in frontal part 32. Frontal part 32 further preferably comprises an opening 153 for a snap tooth of drawer 40 for allowing a snap connection between frontal part 32 and drawer 40.

According to alternative embodiments, the handle 58 can be provided on the frontal part 32 in alternative ways, for example it can be integrated to this frontal part. In a further alternative embodiment also the frontal part 32 can be provided on the crisper 30 in alternative ways, for example it can be integrated to the crisper.

The described design allows a convenient and easy replacement of the membrane 70. Shell 82 is preferably removed from frontal part 32 and shell 84 is removed from shell 82. Shell 82 preferably comprises a fulcrum 142 which engages with the suitable recess 144 provided on the shell 84; moreover, the shell 82 preferably comprises tooth seats 143, preferably provided on the opposite side than that in which the fulcrum 142 is provided, suitable to allow the engagement of the snap teeth provided on the shell 84, preferable in the side opposite than that the recess 144 are provided. With this preferred configuration, the snap connection between the shell 82 and the shell 84 is provided firstly through the engagement of the fulcrum 142 of the shell 84 (preferably already containing the membrane 70) with the recess 144 of the shell 84, then rotating the shell 82 around the fulcrum 142 toward the shell 84 up to engagement of the snap teeth 145 with the tooth seats 143.

Before or after the shells disengagement, the shell 82 can be preferably disengaged from the front part 32, through the disengagement of the snap elements 90, 92, 94, 96 provided on the shell 82 from the recesses 100, 102, 104, 106 provided on the frontal part 32.

According to alternative embodiments, the shell 82 can be provided in the front part 32 in different ways, for example through a unreleasable connection between these two components or through the integration of this frame on the front part; in these last two alternatives the membrane can be sandwiched between the frame 82 and the frame 84 through the connection of the frame 84 with the frame 82 unreleasable connected/provided on the front part.

As soon as the shell 82 is released from the shell 84, the membrane 70 can be released from the shells and a new membrane 70 can be arranged in a sandwiched way between both shells 82, 84. Shells 82, 84 are then connected to each other, and shell 82 is connected again to frontal part 32. Alternatively, shell 84 can be removed from shell 82 while shell 82 is still connected to frontal part 32, and then the membrane 70 is replaced. Afterwards, shell 84 is again connected to shell 82.

Also, shells 82, 84 or handle 58 can be replaced if desired or needed, while frontal part 32 does not need to be altered.

On a front side of handle 58, an aesthetic element 120 is provided which preferably extends over the whole width of handle 58. The aesthetic element can be chosen to fit to the overall design of the household appliance 2. In order to match a design of the appliance, only a handle 58 with a matching visual appearance needs to be chosen and connected to frontal part 32. Thus, a set of designs can be realized only by replacing the handle 58. The frontal part 32 and drawer part 40 can be identical for these cases.

FIGS. 7-10 show further views of crisper 30. As can be inferred from these figures, drawer part 40 can be pulled out of crisper housing 42 by gripping handle 58 and pulling drawer part 40. Drawer part 40 can be pushed back into housing 42 by pushing handle 58.

The preferred embodiment shown comprises one membrane 70 which extends essentially over the whole width of crisper 30. It is preferably that membrane 70 extends at least one half of width of crisper 30. In further preferred embodiments, two or membranes 70 can be provided which can differ in their permeability. In this way, the atmospheric conditions in crisper 30 can be divided in separate regions or the overall humidity exchange can be controlled in a more precise way.

The invention thus conceived can be subjected to numerous modifications and variants all falling within the scope of the inventive concept.

In addition, all details can be replaced by other technically equivalent elements. In practice, all the materials used, as well as the shapes and contingent dimensions, may vary depending on the requirements without departing from the scope of protection of the following claims.

The invention claimed is:

1. Household appliance (2), comprising a casing (4) defining an inner compartment (10) in which a crisper (30) is arranged, whereby said crisper (30) comprises a frontal part (32) and further comprises a permeable membrane (70) allowing contact from an inner space of said crisper (30) to an atmosphere outside of said crisper (30), whereby said membrane (70) is arranged on said frontal part (32), and whereby a handle (58) is provided, wherein said handle (58) and said membrane (70) are dimensioned and arranged in such a way that said membrane (70) is at least partially covered from view by said handle (58) in a frontal direction (72) towards said crisper (30).

2. The household appliance (2) according to claim 1, whereby a height (h) of said handle (58) essentially corresponds to a height (H) of said membrane (70).

3. The household appliance (2) according to claim 1, whereby in a lateral direction said membrane (70) extends over more than half of a width of said crisper (30).

4. The household appliance (2) according to claim 1, whereby said frontal part (32) is detachably connected to a drawer part (40).

5. The household appliance (2) according to claim 4, whereby said connection between said frontal part (32) and said drawer part (40) is a snap connection, preferably with three snap elements arranged on said drawer part (40) which engage in corresponding recesses on said frontal part (32) or vice versa.

6. The household appliance (2) according to claim 1, whereby said membrane (70) is arranged in at least one shell (82, 84) which is attached to said frontal part (32).

7. The household appliance (2) according to claim 6, whereby said shell (82, 84) is attached to said frontal part (32) on a side facing an interior space of said crisper (30) in a mounted position.

8. The household appliance (2) according to claim 6, whereby said shell comprises a first shell (82) and a second shell (84) attached to each other, said membrane (70) being arranged between said first shell (82) and said second shell (84).

9. The household appliance (2) according to claim 8, whereby said shells (82, 84) are attached to each other by a snap connection (90-96; 100-106).

10. The household appliance (2) according to claim 1, whereby on said frontal part (32) two or more membranes (70) are arranged adjacent to each other.

11. The household appliance (2) according to claim 10, whereby at least two of said membranes (70) differ in their permeability.

12. The household appliance (2) according to claim 1, whereby a decorative element (120) is arranged on said handle (58).

13. The household appliance (2) according to claim 1 which is built as a refrigerating and/or freezing appliance.

14. Method for mounting a membrane (70) to a crisper (30) comprising a frontal part (32), said membrane (70) allowing contact from an inner space of said crisper (30) to an atmosphere outside said crisper (30), whereby said membrane (70) is positioned in at least one shell (82, 84), whereby said shell (82, 84) is associated to said frontal part (32), whereby said membrane (70) is arranged in such a way that it is at least partially covered from view by a handle (58) in a frontal direction (72) towards said crisper (30).

* * * * *